United States Patent [19]

Boyer

[11] 3,943,783

[45] Mar. 16, 1976

[54] STORABLE RACK ASSEMBLY

[75] Inventor: Harold E. Boyer, Anna, Ohio

[73] Assignee: Bell and Howell Company, Sidney, Ohio

[22] Filed: Aug. 22, 1974

[21] Appl. No.: 499,610

Related U.S. Application Data

[62] Division of Ser. No. 314,923, Dec. 14, 1972.

[52] U.S. Cl. ..... 74/89.21; 33/139

[51] Int. Cl.[2] ..... F16H 29/20

[58] Field of Search ..... 74/89.21, 89.2; 33/140, 33/139, 137 R; 270/68 A, 68 R

[56] References Cited

UNITED STATES PATENTS

| | | | |
|---|---|---|---|
| 2,824,374 | 2/1958 | Abrams et al. | 33/140 |
| 2,854,753 | 10/1958 | Caparros | 33/139 |
| 3,495,818 | 2/1970 | Marin | 270/68 R |
| 3,625,077 | 12/1971 | Bernard et al. | 74/89.21 |

*Primary Examiner*—Benjamin W. Wyche
*Assistant Examiner*—F. D. Shoemaker
*Attorney, Agent, or Firm*—Griffin, Branigan and Butler

[57] ABSTRACT

A storable rack assembly to be used to drive a paper stop of a buckle-type sheet folding pan includes a perforate reversed crown extension spring attached at its outer end to the paper stop while the opposite end thereof is coiled within a housing. A rotatable sprocket located outside of the housing meshes with perforations in the reversed-crown extension spring to drive the spring and thereby move the paper stop. An indicator mechanism for indicating the amount of movement of the paper stop includes an indicator sprocket, which rotates with the rotatable sprocket and meshes with apertures in an indicator steel band. The storable rack assembly is mounted on a bias bar which, in turn, is pivotally mounted on the fold pan.

4 Claims, 10 Drawing Figures

FIG. 1
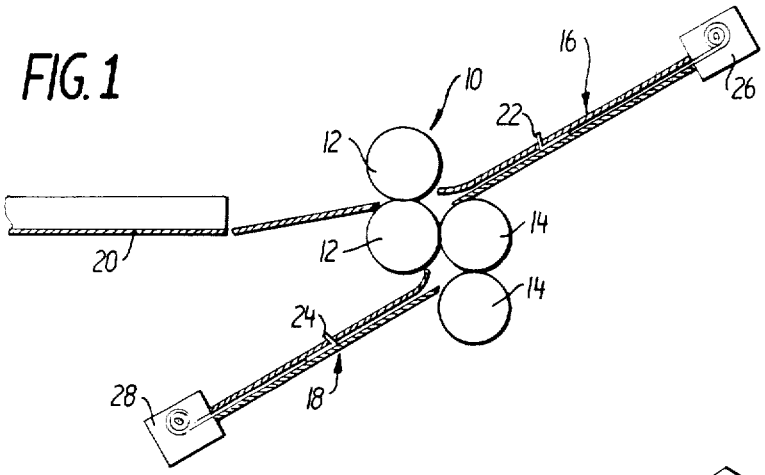
FIG. 2
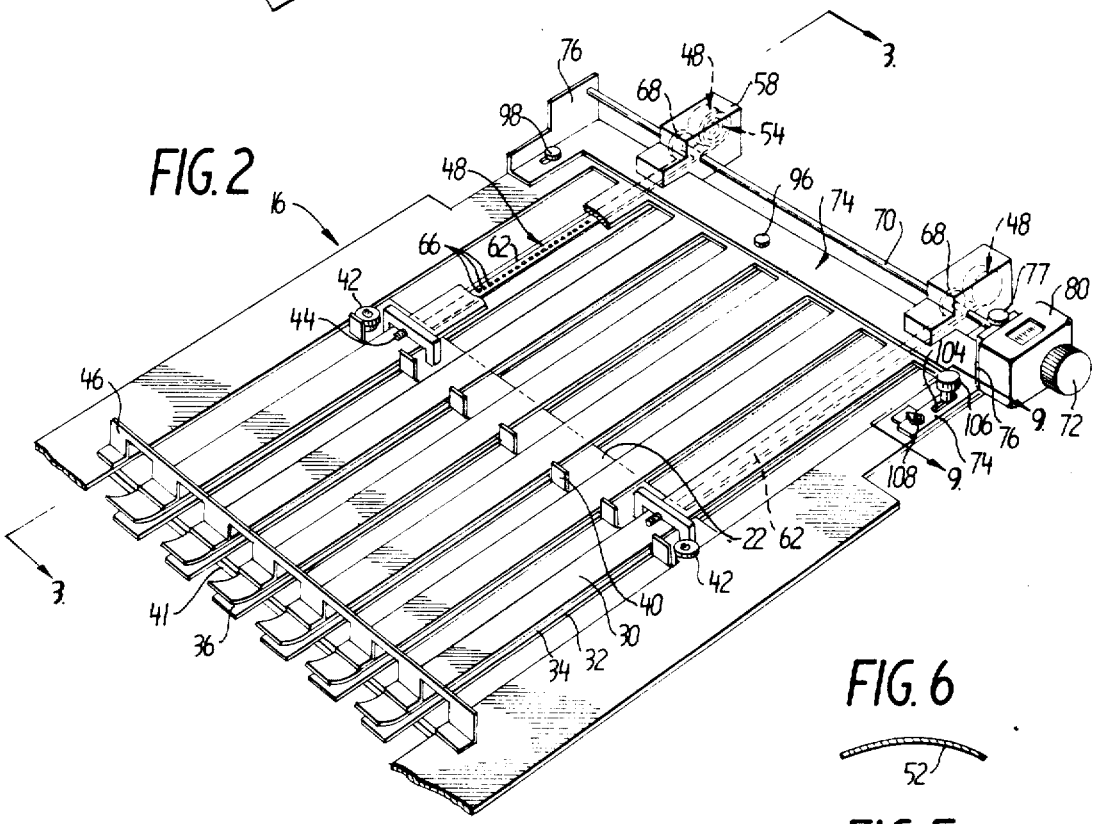
FIG. 6
FIG. 4
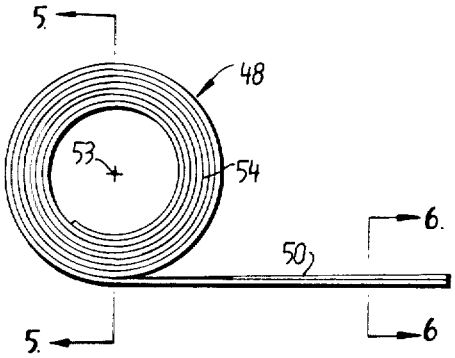
FIG. 5
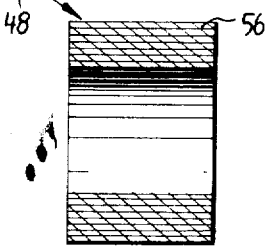

STORABLE RACK ASSEMBLY

This is a division of application Ser. No. 314,923, filed Dec. 14, 1972.

BACKGROUND OF THE INVENTION

This invention relates broadly to buckle-type sheet folding machines and more particularly to mechanisms for adjusting paper stops in fold pans of buckle-type sheet folding machines.

Stated briefly, a buckle-type folding machine normally comprises a series of rollers and fold-pan assemblies. A sheet of paper to be folded is inserted between two rotating rollers of a first roller set and is driven by these two rollers into a fold pan of a fold-pan assembly. A forward edge of the sheet eventually strikes a paper stop in the fold-pan; however, the two rollers continue to feed the sheet forward. Thus, the sheet buckles and the bulge of this buckle eventually extends between two rollers of a second roller set. These rollers fold the sheet at the bulge and feed this folded edge into a second fold pan of a second fold pan assembly. Upon striking a second paper stop there is a new buckle in the sheet and this buckle is, in turn, inserted between two rollers of a third roller set. This process continues until the sheet is folded a desired number of times.

In most buckle-type folding machines the paper stops of the fold pan assemblies are adjustable so that the positions of folds on sheets can be controlled.

In most prior art sheet folding apparatus it is difficult to accurately adjust the positions of paper stops, and, in some prior art devices, it is actually necessary to remove the fold pan assemblies in order to adjust their positions.

U.S. Pat. No. 3,495,818 to Marian describes a sheet folding apparatus wherein paper stops can be adjusted relatively easily by means of negator springs. In this device, two sets of springs are wound on a single shaft for each paper stop. Extensions of one set of the springs are attached directly to a front side of the paper stop and extensions of the other spring set extend around pulleys and are attached to the back side paper stop. With this arrangement the two sets of springs tend to oppose one another and balance the position of the paper stop. To change the position of the paper stop the shaft is rotated.

Marian's device, however, requires a relatively large amount of space and is somewhat complicated in structure. It is therefore an object of this invention to provide an adjusting apparatus for paper stops which is accurate and convenient to use, but yet is relatively small and uncomplicated.

The adjusting mechanisms of some prior-art devices include indicating means for indicating the positions of adjustable paper stops. Some of these indicating devices are inaccurate and some of them are difficult to read. It is therefore yet another object of this invention to provide an indicating device for a paper stop adjusting means which is accurate and relatively easy to read.

Another problem which exists in the prior art is that of making folds on sheets which are perpendicular or parallel with printed material on the sheets. Normally, paper stops are perpendicular with longitudinal axes of fold pans so that sheet edges registered by paper stops are also perpendicular with longitudinal axes of the fold pans. The resulting folds of such sheets are parallel with these registered edges. However, it is often the case that printed material on sheets is not perpendicular or parallel with the sheets' edges. It is, therefore, sometimes desirable to register the sheets at slight angles relative to the fold pans' longitudinal axes so that folds can be made square with the printed material. Thus, it is yet another object of this invention to provide a paper-stop adjusting means which can be used to position a paper stop at an angle relative to a fold pan's longitudinal axis.

SUMMARY OF THE INVENTION

According to the principles of this invention a fold pan's paper-stop adjusting linkage comprises reversed-crown extension springs. The reversed-crown extension springs are designed so that their extended portions and coiled portions are balanced, with no tendency toward either coiling or extending. Shaft-mounted sprockets drive extended portions of the reversed-crown extension springs which, in turn, drive the paper stop. The sprockets are mounted on a shaft which is manually rotated. Also mounted on the shaft is an indicator sprocket for driving a steel band having indicia thereon to indicate the position of the paper stop. The shaft and sprockets are mounted on a biasing bar which is pivotable relative to the fold pan. Thus, the sprockets can be placed at an angle to the fold pan. This, in turn, moves the paper stop to a angled position relative to the fold pan.

The reversed-crown extension springs can be used to move the paper stop to a forward position, where it acts as a deflector which prevents a paper sheet from entering the fold pan. An abutment mechanism is used to properly position the paper stop when it is used as a deflector. If the biasing bar of this invention is positioned to place the paper stop at an angle relative to the fold pan when the paper stop is used as a deflector, the mechanism automatically squares the paper stop relative to the fold pan.

BRIEF DESCRIPTION OF THE DRAWINGS

The foregoing and other objects, features and advantages of the invention will be apparent from the following more particular description of a preferred embodiment of the invention as illustrated in the accompanying drawings, in which reference characters refer to the same parts throughout the different views. The drawings are not necessarily to scale, emphasis instead being placed upon illustrating the principles of the invention in a clear manner.

FIG. 1 is a schematic side view of a portion of a folding machine employing principles of this invention;

FIG. 2 is an isometric view of a fold-pan assembly employing principles of this invention;

FIG. 4 is a side view of a reversed-crown extension spring employed in the FIGS. 1–3 embodiment of this invention;

FIG. 5 is a sectional view taken on line 5—5 in FIG. 4;

FIG. 6 is a sectional view taken on line 6—6 in FIG. 4;

DESCRIPTION OF THE PREFERRED EMBODIMENTS

Figure 3:
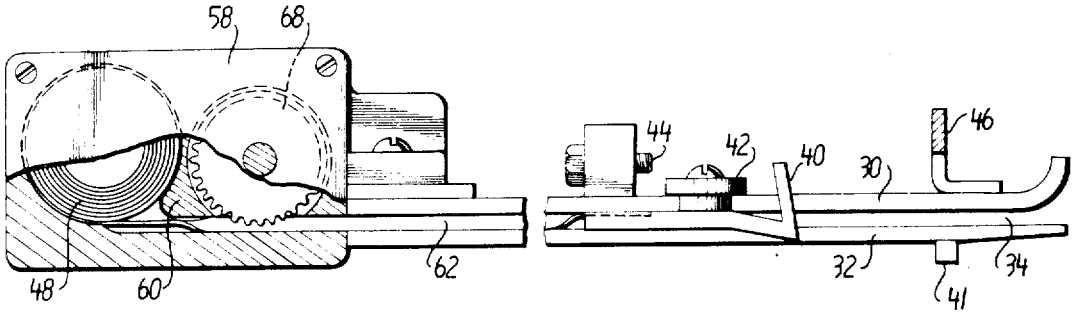
FIG. 3 is a sectional view taken on line 3—3 in FIG. 2.

Referring now to FIG. 1, there is shown a portion of a sheet folding machine 10 which includes a first roller set 12, a second roller set 14 (having a common roller with the first roller set 12), a first fold-pan assembly 16, a second fold pan assembly 18, and a register assembly 20. The first and second fold pan assemblies 16 and 18 include paper stops 22 and 24 and paper stop adjusting devices 26 and 28.

Referring now to FIG. 2 where the first pan assembly 16 is shown in more detail — it should be understood that, although not also shown in detail, the second fold pan assembly 18 is essentially the same as the first fold pan assembly 16 — the first fold pan assembly 16 comprises top and bottom plates 30 and 32 which define a space 34 between them and a fold pan mouth 36 for receiving paper sheets.

The paper stop 22 is movable in the space 34. It can be seen in FIG. 3 that tooth-like stopping members 40 of the paper stop 22 extend both downwardly through slits in the bottom plate 32, and upwardly through slits in the top plate 30. Thus, sheets are prevented from wedging between the stopping members 40 and either the top or bottom plates 30 and 32. Rollers 42, mounted on the paper stop, 22 make contact with longitudinal edges of the top plate 30 to aid the paper stop 22 in moving easily in the space 34.

A support bar 41 is mounted across the bottom of the bottom plate 32 for the purpose of supporting segments of this plate.

At least two abutment screws 44 are mounted on the top surface of the paper stop 22 at such a height that they will make contact with an abutment bar 46, mounted on the top surface of the top plate 30, when the paper stop 22 is moved to the fold pan mouth 36. The tooth-like stopping members 40 can easily pass under the abutment bar 46. The purpose of this will be described below.

Attached to the paper stop 22 are reversed-crown extension springs 48 suitable springs of this type are described in U.S. Pat. No. 2,956,795 to Foster.

Basically, with reference to FIGS. 4, 5, and 6, an extended portion 50 of such a spring has a cross section 52 with a "cross-sectional curvature" in which a concave side is away from a central axis 53 of a coiled portion 54. The coiled portion 54 has a substantially flat cross section 56. Such a reversed-crown extension spring is prestressed so that it tends toward a coiled condition 54; however, as it moves toward a coiled condition it must flatten the cross curvature of the extended portion 50 of the spring.

The reversed-crown extension springs of this invention have cross curvatures of such amounts that they balance the tendency of the springs to coil; thus, zero forces are required to maintain the springs in extended or coiled conditions.

Portions of these springs which are extended tend to remain extended and are rigid enough to prevent movement of the paper stop 22 due to forces of paper sheets hitting the paper stop.

Returning to FIG. 2, coiled portions 54 of the reversed-crown extension springs 48 are stored in spring housings 58, which are shown in more detail in FIG. 3. The spring housings 58 provide internal guides 60 for aiding in coiling the reversed-crown extension springs 58. It can be seen in FIG. 3 that an extended segment 62 of the reversed crown extension spring 48 assumes a cross curvature configuration.

The reversed-crown extension springs 48 have accurately-spaced rectangularly-shaped apertures 66 (FIG. 2) positioned longitudinally thereon which mesh with sprockets 68 located in the spring housings 58. When the sprockets 68 are rotated they cause the reversed-crown extension springs 48 to coil, or uncoil, depending on the direction in which they are rotated. Rotating the sprockets 68 also causes the extended segments 62 of the reversed-crown extension springs 48 to move longitudinally along the fold-pan assembly 16, and, in turn, move the paper stop 22 toward and away from the fold-pan mouth 36.

The sprockets 68 are mounted on a drive rod 70 which is rotated by means of a knob 72. The spring housings 58 are fixidly mounted on a bias bar 74 and the drive rod 70 is mounted for rotation on flanges 76 of the bias bar 74. The drive rod 70 can be locked at various angular positions by means of a locking knob 77. Also mounted on a flange 76 of the bias bar 74 is an indicating assembly 80.

Figure 7:
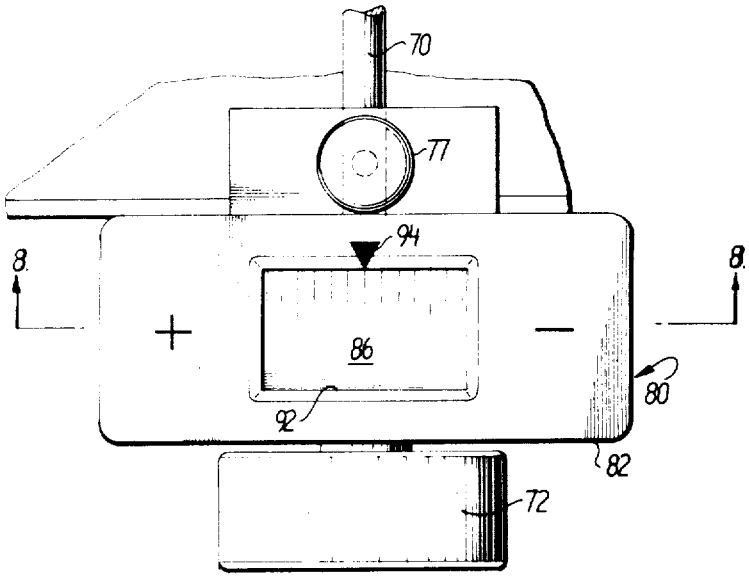
FIG. 7 is an enlarged view of an indicator assembly employed in the FIGS. 1-3 embodiment of this invention.
Figure 8:
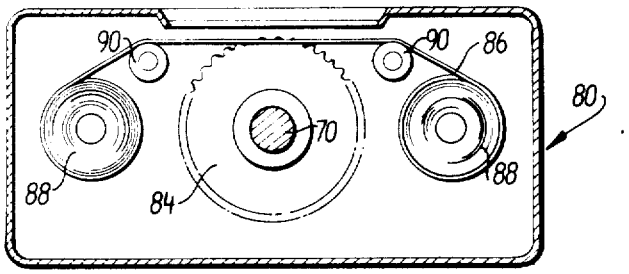
FIG. 8 is a sectional view taken on line 8—8 in FIG. 7.

The indicating assembly 80, shown in greater detail in FIGS. 7 and 8 comprises an indicator housing 82, an indicator drive sprocket 84, a spring steel scale 86, storage rollers 88 and guide rollers 90. The indicator drive sprocket 84 is mounted on the shaft 70 to turn with the shaft. Teeth of the indicator drive sprocket 84 mesh with apertures (not shown) in the spring steel scale 86 to transfer portions of the spring steel scale from one of the storage rollers 88 to the other. The upper surface of the spring steel scale 86 has graduated indicia thereon which can be read through a transparent aperture 92 in the top of the indicator housing 82, relative to an index mark 94 on the indicator housing 82. Such a reading provides an indication of the position of the paper stop 22 because of the continuous, positive linkage formed by the reversed-crown extension springs 48, the sprockets 68, the drive rod 70 and the indicator drive sprocket 84.

Figure 9:
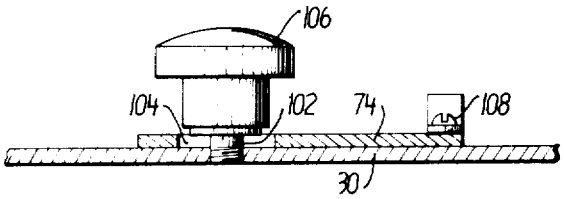
FIG. 9 is a sectional view taken on line 9—9 in FIG. 2.

Returning to FIG. 2, the bias bar 74 is pivotally attached to the top plate 30 at its center by means of pivot screw 96. A guide pin 98, at one end of the bias bar, extends through a slot 100 in the bias bar 74 and is anchored in the top plate 30. A lock screw 102 (FIG. 9), at the other end of the bias bar, extends through a slot 104 in the bias bar and is also anchored in the top plate 30. A lock-screw knob 106 (FIGS. 2 and 9), can be screwed down on the biasing bar 74 to lock it into a fixed position relative to the top plate 30. An indicator 108 mounted on the bias bar 74 indicates this relative position on a graduated scale on the top plate 30.

In operation, with reference to FIG. 1, a paper sheet from the paper register assembly 20 is fed by the first roller set 12 into the first fold pan assembly 16 until its forward edge hits the paper stop 22, at which time the sheet buckles. The buckle is folded by the second roller set 14 and the forward edge of the fold is fed into the second fold pan assembly 18 until it hits the stop 24. Again a buckle and fold occur.

With reference to FIG. 2, when it is desired to adjust the positions of the paper stops 22 or 24 (FIG. 2 is concerned with the paper stop 22 however, paper stop 24, is similarly adjusted) the knob 72 is turned. This, in turn, turns the sprockets 68 which move the extended segments 62 of the reversed-crown extension springs 48 longitudinally. This of course, moves the paper stop 22 to a desired position. The location of the paper stop 22 can be read from the spring steel scale 86 of the indicator assembly 80, which is also moved when the knob 72 is rotated via the indicator drive sprocket 84.

If it is desired to fold paper sheets whereon printed matter is slightly skewed relative to the sheet's edge, the lock-screw knob 106 (FIGS. 2 and 9) is loosened, and the bias bar 74 is manually pivoted about the pivot screw 96. The lock-screw knob 106 is then tightened. This operation places the bias bar 74 at an angle relative to the top and bottom plates 30 and 32. Since the spring housings 58 and the drive rod 70 are mounted on the bias bar 74, it follows that the paper stop 22 is also placed at an angle relative to the top and bottom plates 32 via the reversed crown extension springs 48. Thus, paper sheets which are stopped by the paper stop 22 are placed on a slight angle relative to the fold-pan assembly 16 so that a fold can be made which is squared with printed matter on the sheets rather than with leading edges of the sheets.

Figure 10:
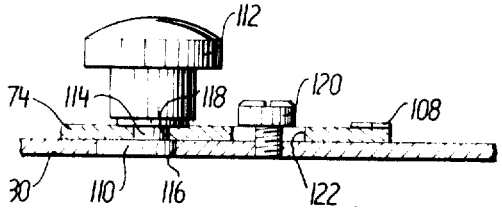
FIG. 10 is a view similar to the sectional view of FIG. 9 but depicts another embodiment of a pivoting mechanism of this invention.

FIG. 10 depicts another embodiment of a mechanism for pivoting the bias bar 74 relative to the top and bottom plates 30 and 32. In this mechanism, a linkage is formed between the top plate 30 and the bias bar 74 by means of an eccentric cam 110 (FIG. 10) which is attached to a knob 112 via a shaft 114. The eccentric cam 110 is positioned in an opening 116 in the top plate 30 and the shaft 114 is journaled in a slot 118 in the bias bar 74. The slot 118 is longitudinally arranged perpendicular to the plane of the sheet on which FIG. 10 is drawn. A lock screw 120 extends through a slot 122 in the bias bar 74 and is screwed into the top plate 30. To operate this mechanism, the knob 112 is rotated so that the eccentric cam 110 causes rotation of the bias bar 74 about the pin 96 and the lock screw 120 is then tightened.

When the paper stop is used as a deflector it is moved to a forward position at the fold-pan mouth 36 and squared with the fold pan assembly 16. To square the paper stop the lock-screw knob 106 is loosened. The paper stop 22 is then moved to the forward position so that one of the abutment screws 44 makes contact with the abutment bar 46. The reversed-crown extension spring nearest the abutment screw which first contacts the abutment bar 46 causes the bias bar 74 to pivot about the pivot screw 95 until the other squaring abutment screw also makes contact with the squaring bar 46. The lock-screw knob 106 is then tightened. Thus, the paper stop 22 is automatically squared with the fold pan assembly 16.

It should be understood that the paper stop adjusting device of this invention requires relatively few parts but yet can be easily operated and is accurate.

The reversed-crown extension springs are self storing and, therefore, provide economy of space.

Further, the indicating assembly of this invention provides an accurate, and easily readable, indication of the position of the paper stop.

Still another advantage of this invention is that it allows operators to produce folds which are squared with printed matter on sheets when the printed matter is skewed relative to edges of the sheets.

While the invention has been particularly shown and described with reference to preferred embodiments, it will be appreciated by those skilled in the art that various changes in form and detail may be made therein without departing from the spirit and scope of the invention. For example, it would be possible to use a crown spring wherein the convex side of the crown is in a direction away from the center of a coil.

The embodiments of the invention in which an exclusive property or privilege are claimed are defined as follows:

1. A rack-and-pinion type linkage system for converting rotary motion into linear motion and thereby moving an object along a linear path said rack-and-pinion type linkage system comprising:

a rack housing, said rack housing defining a chamber, said rack housing further defining a guiding surface located outside, but adjacent to, said chamber and being tangentially disposed to said chamber;

a crown extension spring being unattached to supporting structure along its length, said crown extension spring having a linear extended portion projecting outside said chamber across said guiding surface and being attached to said object at an outer end portion thereof only, and a stored, coiled, portion located in said chamber, said crown extension spring having a series of apertures longitudinally disposed therealong;

a pinion assembly comprising a gear means rotatably mounted on said housing adjacent said guiding surface, but on the opposite side of said spring extended portion from said guiding surface, for driving said crown extension spring, said gear means having teeth which mesh with said apertures; and a drive means linked to said gear means for rotating said gear means in either of opposite selected directions in response to application of an external force to said drive means, thereby linearly moving said crown-extension-spring extended portion, along with said attached object and selectively coiling and uncoiling said crown-extension-spring coiled portion.

2. A rack-and-pinion type linkage system as claimed in claim 1 wherein is further included an indicating means linked to said gear, said indicating means including a measuring scale which moves proportionately to the rotation of said gear and including indicia thereon for indicating the extent to which the crown-extension-spring linear extended portion projects outside said chamber.

3. A rack-and-pinion type linkage system as claimed in claim 2 wherein:

said indicator includes an indicator drive gear which is linked to, and rotates with, said rotatable gear; and said scale means comprises an elongated indicating band having apertures therein which mesh with said indicator drive gear, said elongated band having said indicating indicia thereon;

whereby, as said rotatable gear is rotated said indicator drive gear is also rotated and moves said indicating band longitudinally to indicate the extent to which said crown extension spring is coiled and uncoiled.

4. A rack-and-pinion type linkage system as claimed in claim 1 wherein said drive means comprises a manual knob.

* * * * *